United States Patent [19]

Glasmire

[11] Patent Number: 4,544,303

[45] Date of Patent: Oct. 1, 1985

[54] PROTECTIVE TRAFFIC BARRIER

[76] Inventor: Samuel G. Glasmire, 1438 Westgate Dr., Bethlehem, Pa. 18017

[21] Appl. No.: 518,545

[22] Filed: Jul. 29, 1983

[51] Int. Cl.[4] ..... E01F 13/00

[52] U.S. Cl. ..... 404/6; 404/9; 116/63 P

[58] Field of Search ..... 404/6–9, 404/15, 16; 116/63 P, 63 C, 63 T

[56] References Cited

U.S. PATENT DOCUMENTS

| | | | |
|---|---|---|---|
| 3,105,457 | 10/1963 | Krueger | 116/63 P |
| 3,455,156 | 7/1969 | Kelly | 116/63 T |
| 4,158,514 | 6/1979 | Dickinson | 404/6 |
| 4,325,651 | 4/1982 | Szegi | 404/6 |
| 4,382,714 | 5/1983 | Hutchinson | 404/6 |

FOREIGN PATENT DOCUMENTS

| | | | |
|---|---|---|---|
| 2316381 | 1/1977 | France | 404/6 |
| 1480331 | 7/1977 | United Kingdom | 404/6 |
| 1554863 | 10/1979 | United Kingdom | 404/6 |

*Primary Examiner*—Stephen J. Novosad
*Assistant Examiner*—Beverly E. Hjorth
*Attorney, Agent, or Firm*—Ruth Moyerman

[57] ABSTRACT

A protective traffic barrier designed to divert motor vehicle traffic away from an object or roadway is disclosed. A base with wedge-shaped projections extending vertically from the base impedes the movement of a motor vehicle across the barrier. The shape of the base may be designed to fulfill a particular function including an opening to allow the barrier to fit over an object to be protected. A resilient, preferably plastic, cover encapsulating the base protects people or animals from contact injury with the wedge-shaped projections while allowing the projections to penetrate a vehicle tire. The cover may be coated with various materials to enhance visibility of the barrier by motor vehicle operators.

13 Claims, 5 Drawing Figures

PROTECTIVE TRAFFIC BARRIER

BACKGROUND OF THE INVENTION

1. Field of the Invention

This invention relates to road structure, and more particularly to traffic barriers.

2. Description of the Prior Art

Many devices are known whose purpose is to function as a traffic barrier. These devices range from the sawhorse-type barrier to the depressable spike plate barrier often observed in parking lot and deck exits. The devices serve to direct the flow of traffic away from a particular roadway or hazard.

However, these devices are limited in that they are easily removed as in the case of the sawhorse device, or permanently sited as in the case of the spike device.

There is, therefore, a need for a protective traffic barrier which is portable but can be securely installed at a desired location.

SUMMARY OF THE INVENTION

The aforementioned prior art problems are overcome by the protective traffic barrier of this invention. The instant protective traffic barrier has a planar base, preferably fabricated from steel plate. An opening in the center of the square is intended to overfit an object to be protected.

A concentric area extending from the opening circumference to the outer edge is the location of wedge-shaped projections which extend perpendicularly upward from the base top. These projections are preferably V-shaped cuts from the base and bent vertically upward.

In use, the barrier is placed over a projecting object, e.g. a water main shut-off valve, by sliding the opening over the object. The valve extension is thereby protected from automobile traffic damage as the wedge-shaped projections impede the movement of a vehicle tire across the barrier. A resilient cover encapsulating the barrier to enclose the wedge-shaped projections protects people and animals from injury, but allows penetration of an automobile tire because of the vehicle weight.

A variation of the device is a rectangular-shaped planar base with wedge-shaped projections along the longitudinal center line and no central opening. A barrier having this configuration may be placed across a roadway, e.g. a driveway, to prevent entrance of unauthorized vehicular traffic. The wedge-shaped projections cut out of the base top and bent vertically upward may also be protected with a resilient, encapsulating cover to prevent injury to people and animals. The weight of a vehicle on the wedge-shaped projections will puncture the vehicle tire despite the protective cover.

Both barrier designs may be secured to the road surface using anchor rods or bolts.

It is, therefore, an object of this invention to provide a protective traffic barrier which may be easily removed from one location to another.

It is yet another object of this invention to provide a protective traffic barrier capable of impeding vehicle traffic movement across an object located in a roadway, e.g. a water main shut-off valve.

It is still another object of this invention to provide a protective traffic barrier which impedes vehicle movement but will not injure people or animals which contact the wedge-shaped projections.

These and other objects will be more readily ascertainable to one skilled in the art from a consideration of the following Figures, descriptions and exemplary embodiments.

BRIEF DESCRIPTION OF THE DRAWING(S)

DETAILED DESCRIPTION OF THE PREFERRED EMBODIMENT(S)

Figure 1:
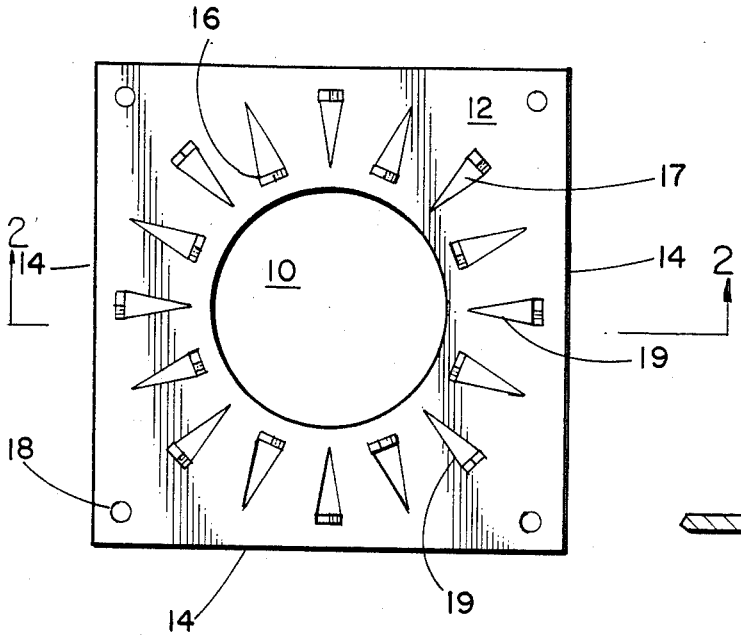
FIG. 1 is a top view of the invention.

Referring now to the drawings, and more particularly to FIG. 1, a top view of the invention is shown with opening 10 located in the center of base 12. The radius of opening 10 is shown approximately two-thirds the distance from the center to outer edge 14 which is a convenient ratio for stabilization of the barrier. Wedge-shaped projections 16 occupy a concentric area between outer edge 14 and opening 10. Projections 16 are created by stamping a V-shaped cut 19 and bending upward the wedge shape created thereby, leaving triangular-shaped voids 17. Holes 18 are provided to anchor barrier to the ground surface.

Figure 2:
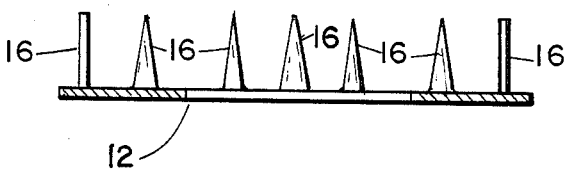
FIG. 2 is a cross sectional view taken on lines 2—2 of FIG. 1.

Referring now to FIG. 2, a cross sectional view of FIG. 1 taken on lines 2—2 is shown with wedge-shaped projections 16 extending vertically upward from base 12.

Figure 3:
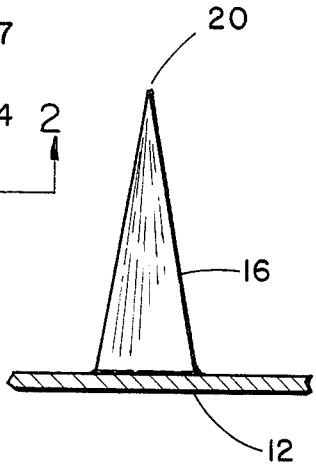
FIG. 3 is an enlargement of the wedge-shaped projections.

Referring now to FIG. 3, a close-up of wedge-shaped projections 16 is shown extending from base 12. In use, the sharp tip 20 of wedge-shaped projections 16 penetrates a vehicle tire which contacts tip 20.

Figure 4:
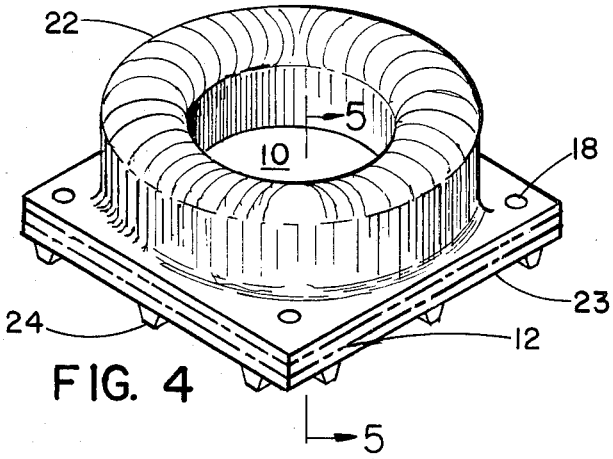
FIG. 4 is an isometric view of the resilient cover.

Referring now to FIG. 4, an isometric view of resilient cover 22 is shown. Resilient cover 22 encapsulates base 12 shown in phantom and wedge-shaped projections 16 (not shown). Holes 18 provide a means for anchoring barrier to the ground surface. Resilient cover 22 protects people and animals by preventing contact with the wedge-shaped projections. However, the weight of a motor vehicle contacting resilient cover 22 will cause sharp tips 20 (shown in FIG. 3) of wedge-shaped projections 16 to penetrate resilient cover 22 and ultimately the vehicle tire. Cover 22 may be made of heavy duty plastic such as the type used today in traffic cones.

Resilient cover bottom 23 has feet 24 which, in use, elevate the barrier above the ground surface, providing means to divert surface water away from the device. Base 12 is shown recessed to permit resilient cover 22 to rest on cover bottom 23, encapsulating base 12, thereby precluding rust erosion of base 12. Resilient cover 22 and cover bottom 23 may be glued together.

Figure 5:
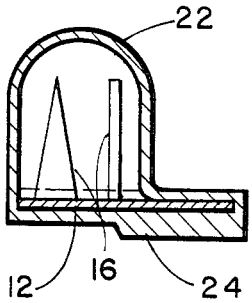
FIG. 5 is a cross sectional view taken on lines 5—5 of FIG. 4.

Referring now to FIG. 5, resilient cover 22 is shown in a cross sectional view taken on lines 5—5 of FIG. 4. Cover 22 is shown generally as doughnut shaped, which shape allows it to overfit projections 16 of base 12 and, together with cover bottom 23, encapsulates base 12.

There are many variations which may be practiced within the scope of this invention. Although the general dimensions of base 12 are a square as illustrated, other configurations may be used which fulfill the intended purpose of a protective barrier including rectangular, circular or semi-circular, and the claims are by no means limited to these examples.

Opening 10, although circular in shape as illustrated, may be varied to fit the dimensions of the object to be protected, or eliminated if no object is to be protected.

While the location of wedge-shaped projections 16 is illustrated encircling opening 10, wedge-shaped projections may be located in a position best suited to carry out the function of impeding a motor vehicle. This position may include, but is not limited to, the longitudinal center line of a rectangular shaped base 12.

The configuration of wedge-shaped projections 16 as illustrated may be varied including, but not limited to, conical shaped or spike shaped. Wedge-shaped projections 16, although illustrated as V-shaped cuts of base 12, may be fabricated from other materials and attached to base 12 by an appropriate means.

Resilient cover 22 and resilient cover bottom 23 may be fabricated of any material of suitable resilience to allow vehicular tire penetration, but which will be thick enough to support the weight of a human. Plastic is suitable. It is also preferred to color the barrier cover with a visibility-enhancing color such as the brilliant orange or fushia colors now conventionally used for this purpose and photoreflective coatings to enhance detection of the barrier at night.

Having now illustrated and described my invention, it is not intended that such description limit this invention, but rather that this invention be limited only by reasonable interpretation of the appended claims.

What is claimed is:

1. A protective traffic barrier comprising:

(a) a generally square planar base having a top and a bottom;

(b) a generally circular opening proximate said base center, said circular opening having a radius generally two-thirds the distance from center to base outer edge; and, (c) a plurality of wedge-shaped projections concentrically arranged between said opening's perimeter and said base outer edge and extending upward from said top, whereby when said barrier bottom is placed on a ground surface with said opening over an object projecting up from the ground, said barrier protects said object from vehicular tire damage.

2. The protective traffic barrier according to claim 1 including, additionally, a resilient, high visibility cover, said cover having a top to encapsulate said projections and a bottom with a plurality of feet to hold said traffic barrier onto the ground surface.

3. A protective traffic barrier comprising:

(a) a generally planar unitary base having an upper-side and a lower side and an opening proximate said base center; and, (b) a plurality of triangular wedge-shaped projections concentrically arranged between said base outer edge and said opening perimeter, said projections extending upward from said base's upper side, whereby, when said base is placed on a ground surface with said opening placed over an object projecting upward from said ground surface, said traffic barrier protects said object from vehicular tire damage.

4. A protective traffic barrier according to claim 3 wherein said planar base is generally square.

5. A protective traffic barrier according to claim 3 wherein said opening is generally circular.

6. A protective traffic barrier according to claim 5 wherein said opening has a radius generally two-thirds the distance from center to said base outer edge.

7. A protective traffic barrier according to claim 3 including, additionally, a resilient cover of an overall size and shape so that it encapsulates said base overfitting said wedge-shaped projections and the edge of said opening, thereby protecting people and animals from potential injury inflicted by contact with said wedge-shaped projections.

8. A protective traffic barrier according to claim 7 wherein said resilient cover includes high visibility color coating to enhance visual detection of said barrier by vehicle operators.

9. A protective traffic barrier according to claim 7 wherein said cover includes photoreflective coating to enhance visual detection at night of said barrier by vehicle operators.

10. A protective traffic barrier according to claim 7 wherein said cover includes a bottom, said cover bottom including a plurality of feet to hold said traffic barrier on the ground surface.

11. A protective traffic barrier according to claim 10 wherein said base is recessed to permit said resilient cover to rest on said cover bottom, thereby encapsulating said base.

12. A protective traffic barrier according to claim 3 wherein said base is fabricated from steel plate.

13. A protective traffic barrier according to claim 3 wherein said wedge-shaped projections are formed from V-shaped cuts from said base bent transversely to project vertically upward.

* * * * *